United States Patent [19]

Becker

[11] Patent Number: 5,012,255

[45] Date of Patent: Apr. 30, 1991

[54] COMBINATION ANTENNA AND WINDSHIELD HEATER

[75] Inventor: Hubert Becker, Hildesheim, Fed. Rep. of Germany

[73] Assignee: Blaupunkt-Werke GmbH, Hildesheim, Fed. Rep. of Germany

[21] Appl. No.: 319,978

[22] Filed: Mar. 7, 1989

[30] Foreign Application Priority Data

Mar. 12, 1988 [DE] Fed. Rep. of Germany ..... 3808401

[51] Int. Cl.[5] ..... H01Q 1/02

[52] U.S. Cl. ..... 343/704; 343/713; 343/767

[58] Field of Search ..... 343/704, 767, 768, 770, 343/905, 711, 713; 219/203

[56] References Cited

U.S. PATENT DOCUMENTS

| | | | |
|---|---|---|---|
| 2,971,191 | 2/1961 | Davis | 343/712 |
| 3,007,164 | 10/1961 | Davis | 343/712 |
| 3,210,766 | 10/1965 | Parker | 343/712 |
| 3,928,748 | 12/1975 | Sauer/St. Gobain | 219/522 |

FOREIGN PATENT DOCUMENTS

| | | | |
|---|---|---|---|
| 2360672 | 5/1975 | Fed. Rep. of Germany . | |
| 0127803 | 7/1985 | Japan | 343/711 |

OTHER PUBLICATIONS

IFI Plenum Abstract of U.S. Pat. No. 3,928,748.

*Primary Examiner*—Rolf Hille
*Assistant Examiner*—Hoanganh Le
*Attorney, Agent, or Firm*—Frishauf, Holtz, Goodman & Woodward

[57] ABSTRACT

A motor vehicle windshield is formed with a transparent vapor-deposited metal coating for windshield heating and with an antenna for radio reception. Preferably, the metal coating is connected to an inner conductor of a coaxial cable leading to the radio receiver, while the outer conductor of the coaxial cable is connected to chassis or ground potential. A slot (10, 20, 30, 40, 55, 56) in the metal coating is dimensioned to have a length of some harmonic of one wavelength in the FM frequency band, a width smaller than a half wavelength, and a minimum spacing a from the supply busses on each side of the windshield.

9 Claims, 3 Drawing Sheets

COMBINATION ANTENNA AND WINDSHIELD HEATER

The present invention relates generally to combination antenna/windshield heaters, and, more particularly, to an improved version of such a combination, in which the antenna is formed as a slot or gap in a metal coating.

BACKGROUND

German Published Examined Application DE-AS 23 60 672 and corresponding U.S. Pat. No. 3,928,748 disclose a prior art heated windshield with antenna. In that conventional vehicle windshield, a system of conductors is provided which simultaneously performs heating and antenna functions. In the windshield, electrical resistance elements are arranged between current supply busses, of which one is located near the upper windshield edge, and the other is located near the lower windshield edge, the heating wires running vertically between the busses. One of the two busses is divided into two parts, the respective adjacent ends of which are capacitively coupled to a receiver. The two parts of the bus, and whatever extensions are attached thereto, thus form a Frequency Modulation (FM) antenna, also known in Germany as a UKW antenna. The specifications of this antenna are derived from theoretical calculation of the lengths of the extensions and subsequent corrections based on empirical measurements.

For some time, there has been discussion of vehicle windshields which are coated over their entire surface with gold or another conductive metal. This metal coating is intended to also serve for windshield heating. For this purpose, busses for heating current supply are arranged at, for example, two opposing windshield edges. Due to the attached metallic layer, none of these busses are adapted to serve as FM antennas. One way nevertheless integrate, into vapor-deposition-coated windshields, which are sensitive in the FM reception bands, as well as in the AM reception bands, if the coating is formed with an uncoated slot having a length approximating a half-wavelength and a width very much smaller, and a minimum spacing from current supply busses on opposing sides of the windshield, and the coating is connected to the receiver.

In the following discussion, the Greek letter lambda or $\lambda$ is the symbol for the wavelength of a particular radio frequency in the radio band which the antenna is designed to receive, typically an arbitrarily chosen frequency at the middle of the band. It is well known that antennas have a resonant frequency which depends upon their length, and receive best signals at that frequency or some harmonic thereof.

DRAWINGS

Three embodiments of windshields formed in accordance with the present invention are illustrated in the drawings, of which:

Figure 4:
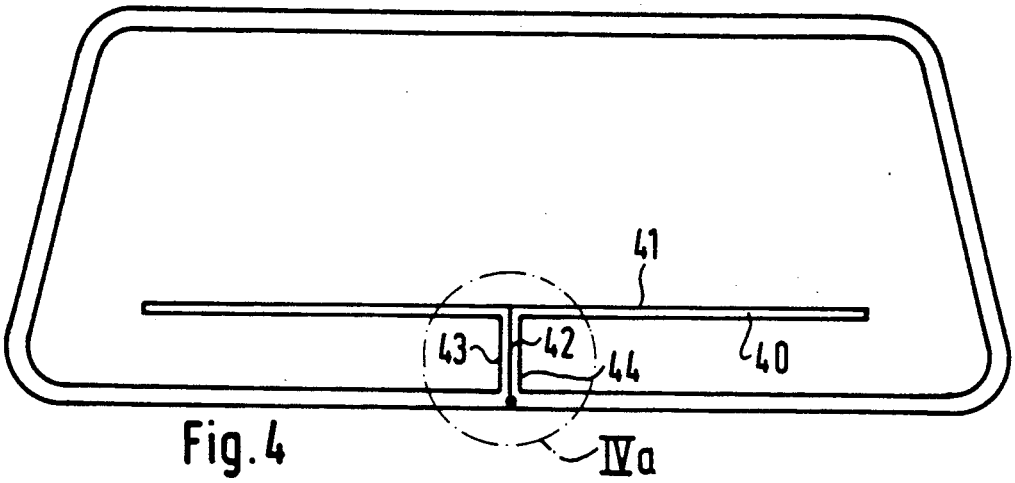
Figure 4A:
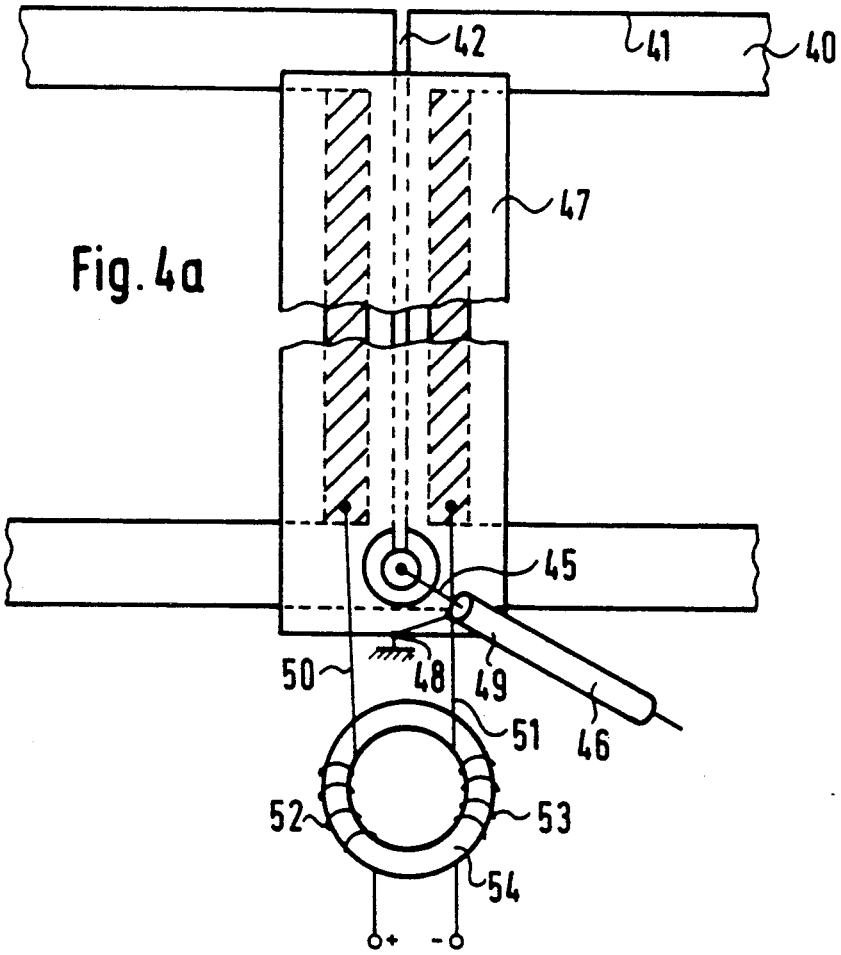
Figure 5:
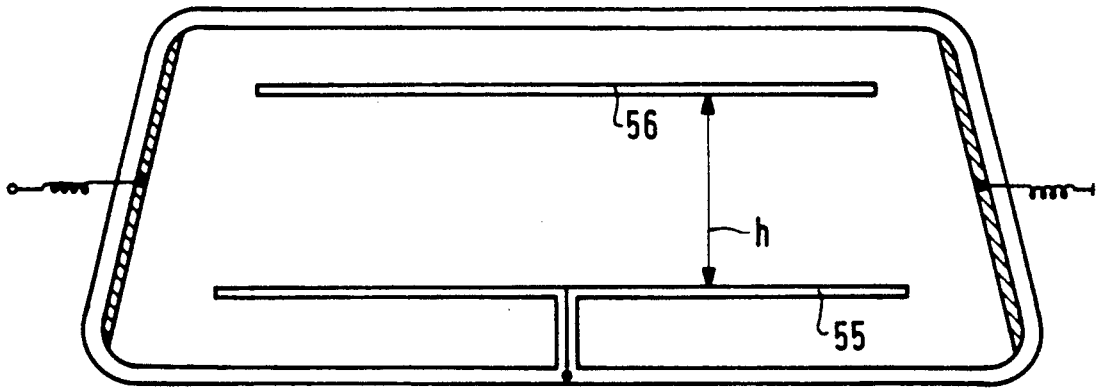

FIGS. 4 and 4*a* illustrates a windshield with connections for the slot antenna via a strip conductor to a coaxial cable; and FIG. 5 illustrates a windshield with slot antenna and reflector.

DETAILED DESCRIPTION

Figure 1:
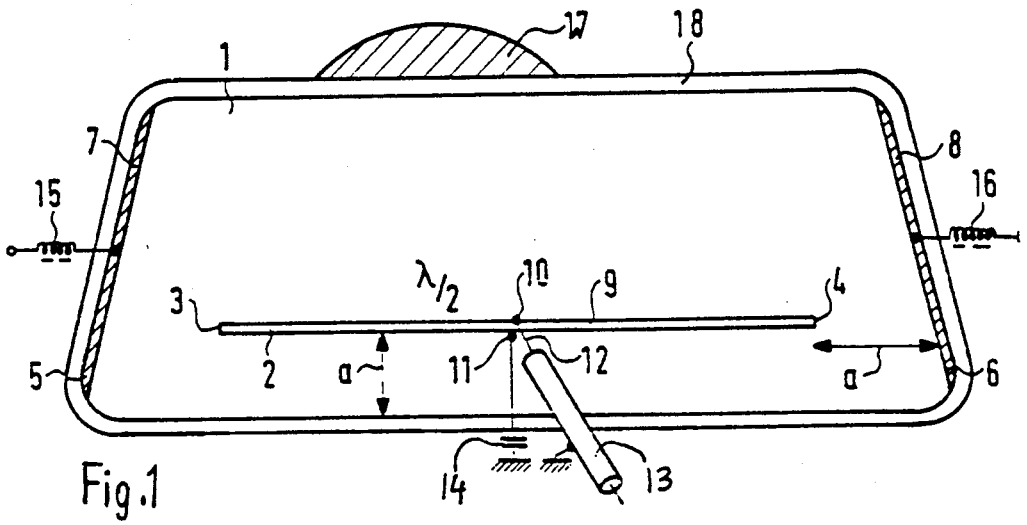
FIG. 1 illustrates a window or windshield with a $\lambda/2$ slot antenna, which is connected to a receiver by coaxial cable.

FIG. 1 illustrates a window or windshield 1 for a motor vehicle, which its outline indicates is intended as a rear or front windshield. This windshield is vapor-deposited in conventional fashion with a good-conducting metal coating, so that the metal coating may be regarded as a low-resistance one.

It is known to use such a metal coating for windshield heating. Further, such tinted windshields inhibit entry of sunlight, and viewing of the interior of the vehicle from outside. These characteristics of the vapor-coated windshield are, however, of merely secondary significance here.

Upon metallic-vapor-coating of the windshield, a slot 2 of sufficient length and slight breadth is kept uncoated, essentially parallel to and at a spacing a from one edge, for example the bottom edge, of the vapor-deposited surface. Current supply for heating current is applied adjacent respective slot ends 3, 4 at other edges 5, 6 of the vapor-deposited surface, for example the left and right edges. The edges of the metal coating itself can form supply busses 7, 8 for such current supply. Alternatively, special metal strips or the like can be affixed to serve as supply busses. In any event, the slot ends 3, 4 remain at a minimum spacing a from the supply busses.

Slot ends 3, 4 could also be angled with respect to a central region 9 of the slot, and could run parallel to supply busses 7,8 in order to achieve a greater overall slot length.

When such a windshield is placed in the electromagnetic field of an FM broadcast transmitter, an alternating electrical field forms over the slot, and a circular alternating current flows around the slot. The length of the slot is selected to correspond approximately to the electrical value $\lambda/2$ in the FM frequency band. This length thus depends upon the dielectric constant $\epsilon_r$ of the glass of the windshield. The breadth of the slot can be kept very small with respect to the half-wavelength $\lambda/2$, while the spacing a is selected to be small with respect to half-wavelength $\lambda/2$.

Preferably, the value of the dielectric constant $\epsilon_r$ is so selected that it is not necessary to angle the slot ends in order to obtain a slot antenna with a value on the order of $\lambda/2$ in the FM band, because angling of the slot ends under certain circumstances degrades the flow of heating current, permitting formation of an unheated zone between the angled ends.

Figure 2:
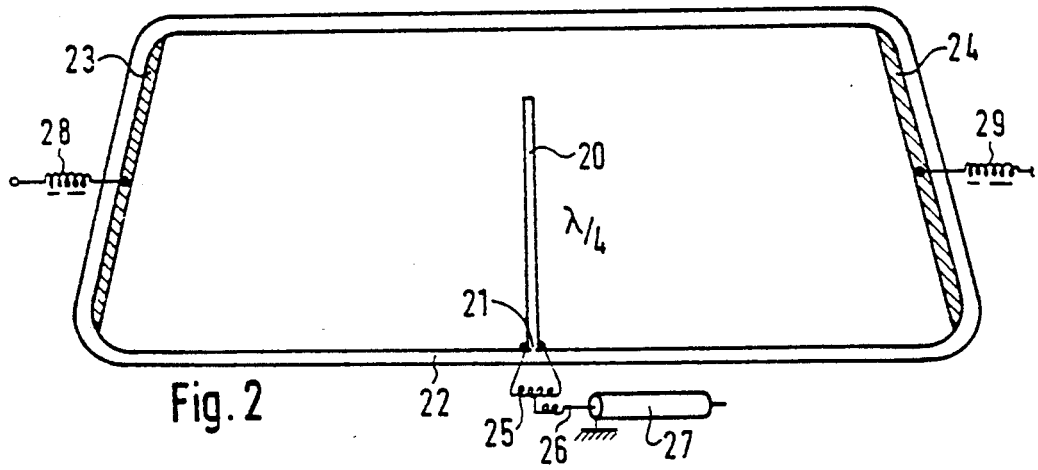
FIG. 2 illustrates a windshield with a $\lambda/4$ slot antenna.

As shown in FIG. 1, in a first embodiment, the middle point 10 of the upper rim of slot 2 is connected to the inner conductor 12 of a coaxial cable leading to the radio receiver, while the middle point 11 of the lower rim of slot 2 is connected over a capacitance 14 to the vehicle chassis surrounding the windshield. An outer conductor 13 of this same coaxial cable is also connected to the vehicle chassis. 5 and 6 are FM (and AM) isolator -blocks 7 is a part of the vehicle chassis and 18 is an isolator gap between the coating and the chassis FIG. 2 illustrates a second embodiment of a slot antenna, whose electrical length in the FM or UKW band is $\lambda/4$. The bottom point 21 of the slot 20 ends in a circumferential free or uncoated area 22. Slot 20 preferably runs essentially vertically into the path of the heating current which is fed between left windshield edge 23 and right windshield edge 24. The two edges of slot 20 are connected at the bottom point 21 by a coil 25, which is also connected to an inner conductor 26 of a coaxial cable, whose outer connector 27 is again connected to the vehicle chassis.

Figure 3:
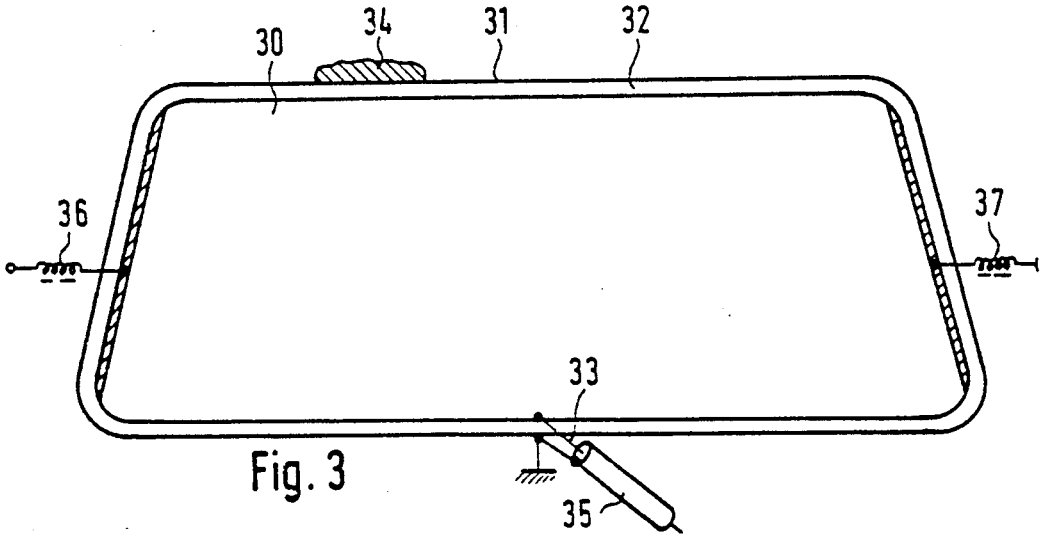
FIG. 3 illustrates a windshield with a $\lambda$ slot antenna.

Since the vapor-deposited surface is surrounded by circumferential free space 22, coil 25 also transmits to the coaxial cable the signals in the AM reception band. 28 and 29 are FM (and AM) isolator-blocks FIG. 3 illustrates a third embodiment, in which a circumferential free space 32, having a whole-wavelength λ electrical length in the FM or UKW band, is left between the vapor-coated surface and the surrounding edge 31 of the windshield. If the inner conductor 33 of a coaxial cable 35 is connected to the vapor-coated surface, for example at the middle of the bottom edge as shown, and the outer conductor is connected to chassis potential, the cable will pick up signals adequate for both FM and UKW and AM reception. In the FM band, the free space 32 acts as a slot antenna, since the metallic chassis rim for the windshield, as indicated at 34, surrounds the windshield 30. In the AM band, the entire vapor-coated surface serves as the conductor, as in the FIG. 2 embodiment. 36 and 37 are FM (and AM) isolator-blocks.

FIG. 4 illustrates a fourth embodiment, in which a strip conductor 42 is used to connect the coaxial cable to the upper rim 41 of slot 40. For this purpose, a T-shaped structure is left uncoated within the coated surface. The strip conductor 42 is arranged between the adjacent vertical edges 43, 44 of the T-shaped area. As shown in more detail in FIG. 4*a*, the lower end of strip 42 is connected to the inner conductor 45 of a coaxial cable 46. The vertical slot is covered by a metallic insulating layer 47 which, together with edges 43, 44, forms a capacitive coupling for a circular alternating current around the slot antenna. The metal of insulating layer 47 is connected at 48 with the chassis, as is the outer conductor 49 of coaxial cable 46.

The edges 43, 44 can also serve as supply busses for heating current. Supply leads 50, 51 to the respective supply busses can be connected to respective coils 52, 53 for improved reception of AM signals. Preferably, these coils 52, 53 can be wound on separate portions of a common toroidal core 54, as shown.

FIG. 5 illustrates an improved version of the slot antenna of FIG. 1. At a spacing h from a first slot 55 analogous to that of FIG. 1, there is provided a second slot 56, which in length and breadth approximately corresponds to the first slot 55. An antenna gain in the horizontal is thereby achieved. The length of slot 56 and the spacing h from slot 55 are a function of the antenna gain and must be selected according to the desired design characteristics.

Various changes and modifications are possible within the scope of the inventive concept. In particular, features of any of the embodiments can be combined with features of other embodiments.

I claim:

1. Tinted motor vehicle windshield having a pair of current supply busses and a tinting vapor-deposited transparent metal coating extending between said supply busses, applied to a glass or plastic substrate, wherein said supply busses (7,8) are arranged along parallel opposing edges of a vapor-coated region of said windshield;

said metal coating is formed with an essentially rectangular slot (2) therein, having a width and a length between a pair of ends (3,4) said slot extending substantially perpendicular to said supply busses, thereby defining a slot antenna, a middle point (10) of a first side of the slot is connected to an inner conductor (12) of a coaxial cable;

a middle point (11) of a second side of the slot is coupled to the outer conductor (13) of the coaxial cable;

the slot length and width are so dimensioned, in dependence upon the dielectric constant of the glass or plastic substrate, that the antenna formed by the slot has an electrical value in an FM reception band on the order of λ/2, while the slot has a width, between said first and second sides, which width is kept very small with respect to the value λ/2, and the slot ends (3,4) approach said supply busses no closer than a spacing a which is small with respect to the half-wavelength λ/2.

2. Windshield according to claim 1, wherein (FIG. 2) said coupling of the middle point (11) of the second side of the slot (2) to said outer conductor (13) is capacitive (14) and said outer conductor (13) is connected to a chassis of said vehicle, and thus is at chassis potential.

3. Windshield according to claim 1 wherein, a first rim of said slot approaches an adjacent corner of said vapor-coated region of said windshield no closer than a spacing a, which is small with respect to half-wavelength λ/2.

4. Windshield according to claim 1, wherein FIG. 1*a*) ends (3, 4) of said slot are angled with respect to a central region (9) thereof.

5. Tinted windshield according to claim 1, wherein a coaxial cable (46) having inner (45) and outer (49) conductors is provided, said metal coating is formed with an essentially T-shaped slot structure (40, 42, 44) therein, a strip conductor (42) connects one edge (41) of said slot structure with said inner conductor (45) of said coaxial cable (46), a pair edges (43, 44) of said metal coating define vertical sides of said slot structure, and a metallic insulating layer (47) covers said vertical sides, said insulating layer being connected to chassis potential.

6. Windshield according to claim 1, wherein (FIG. 5) a first slot (55) is provided, and a second slot (56), having length and width approximating that of said first slot, is provided, located at a spacing h from said first slot.

7. Windshield according to claim 1, wherein said supply busses comprise portions (23, 24) of said vapor-deposited metal coating.

8. Tinted motor vehicle windshield having a pair of current supply busses and a tinting vapor-deposited transparent metal coating extending between said supply busses, applied to a glass or plastic substrate, wherein, a coaxial cable having inner (26) and outer (27) conductors is provided, a slot (20) is formed in said metal coating, extending between said supply busses (23, 24), thereby defining facing edges of said metal coating, said facing edges being electrically connected at a bottom point (21) of said slot through a coil (25), said coil (25) being connected to said inner conductor (26) of said coaxial cable and said outer conductor of said coaxial cable being connected to chassis potential of said vehicle.

9. Windshield according to claim 8, wherein said supply busses comprise portions (23, 24) of said vapor-deposited metal coating.

* * * * *